US008308267B2

(12) United States Patent
Iwata et al.

(10) Patent No.: US 8,308,267 B2
(45) Date of Patent: Nov. 13, 2012

(54) DROPLET DISCHARGE DEVICE, METHOD FOR DISCHARGING DROPLET, METHOD FOR FORMING PATTERN, PATTERN FORMED MEMBER, ELECTRO-OPTICAL DEVICE, AND ELECTRONIC APPARATUS

(75) Inventors: Yuji Iwata, Nagano (JP); Tatsuya Ito, Nagano (JP); Osamu Kasuga, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 839 days.

(21) Appl. No.: 12/473,966

(22) Filed: May 28, 2009

(65) Prior Publication Data

US 2009/0303274 A1 Dec. 10, 2009

(30) Foreign Application Priority Data

Jun. 9, 2008 (JP) ..... 2008-150173

(51) Int. Cl.
*B41J 29/393* (2006.01)
*B05C 11/00* (2006.01)

(52) U.S. Cl. ..... 347/19; 118/667

(58) Field of Classification Search ..... None
See application file for complete search history.

(56) References Cited

U.S. PATENT DOCUMENTS

| | | | | |
|---|---|---|---|---|
| 7,429,098 | B2 | 9/2008 | Murakami et al. | |
| 2002/0041300 | A1 * | 4/2002 | Iwasaki et al. | 347/19 |
| 2003/0058293 | A1 * | 3/2003 | Tamura et al. | 347/17 |
| 2005/0168510 | A1 * | 8/2005 | Asano et al. | 347/17 |
| 2008/0007587 | A1 * | 1/2008 | Watanabe | 347/19 |

FOREIGN PATENT DOCUMENTS

| | | | |
|---|---|---|---|
| JP | 2004-209429 | A | 7/2004 |
| JP | 2005-280343 | A | 10/2005 |
| JP | 2007-001035 | A | 1/2007 |
| JP | 2008-080730 | A | 4/2008 |

* cited by examiner

*Primary Examiner* — Dah-Wei Yuan
*Assistant Examiner* — Charles Capozzi
(74) *Attorney, Agent, or Firm* — Global IP Counselors, LLP

(57) ABSTRACT

A droplet discharge device includes a head for discharging a functional liquid, a driving voltage generation unit for generating a driving voltage to drive the head, first and second temperature acquisition units, a temperature difference computing unit, and a driving voltage correction unit. The first and second temperature acquisition units are configured to acquire temperature of the functional liquid in the head as first and second temperatures, respectively, when the head is in a head waiting state and in a head driven state, respectively. The temperature difference computing unit is configured to compute a temperature difference between the first and second temperatures. The driving voltage correction unit is configured to correct the driving voltage based on the temperature difference. The driving voltage generation unit is configured to generate the corrected driving voltage to the head when the head is in the head driven state.

11 Claims, 9 Drawing Sheets

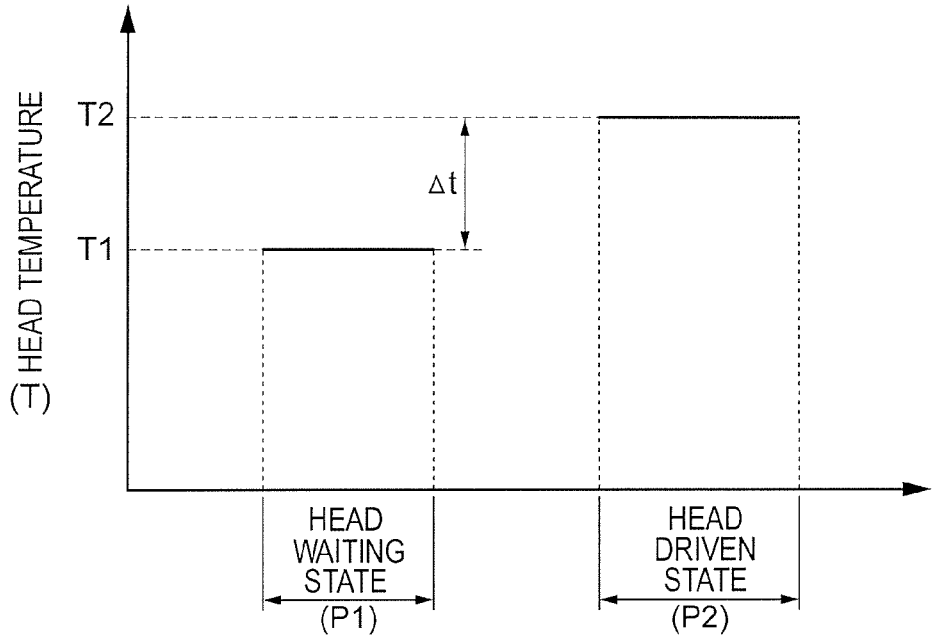
FIG. 4
FIG. 5A
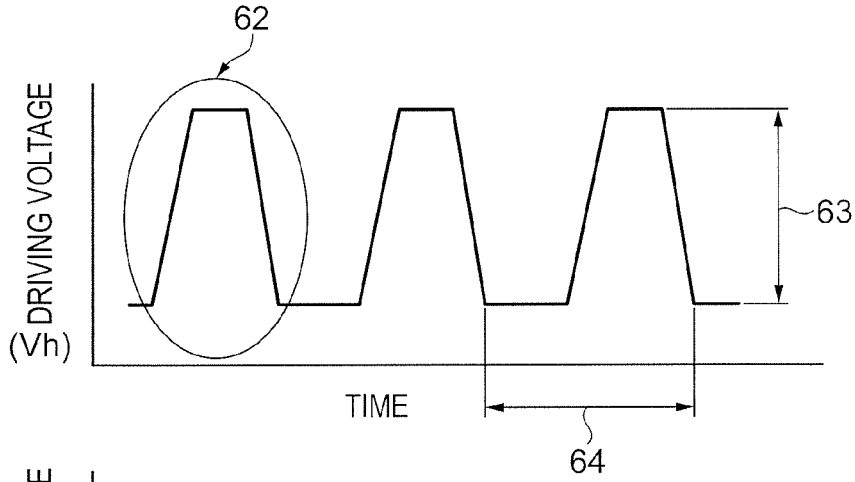
FIG. 5B
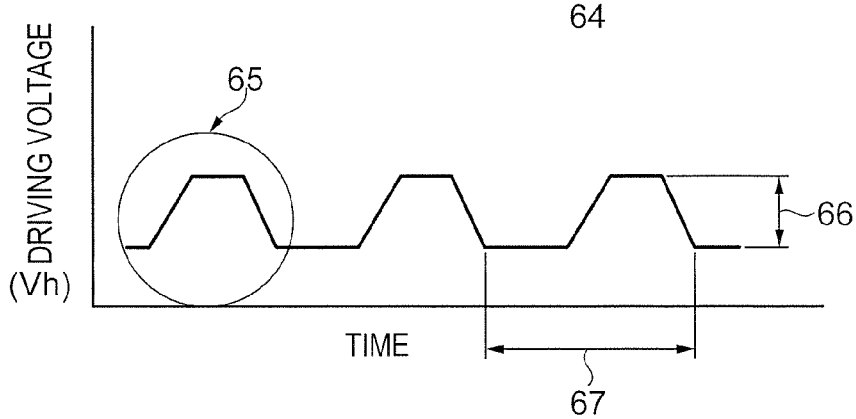

DROPLET DISCHARGE DEVICE, METHOD FOR DISCHARGING DROPLET, METHOD FOR FORMING PATTERN, PATTERN FORMED MEMBER, ELECTRO-OPTICAL DEVICE, AND ELECTRONIC APPARATUS

BACKGROUND

1. Technical Field

The present invention relates to a droplet discharge device, a method for discharging a droplet, a method for forming a pattern, a pattern formed member, an electro-optical device, and an electronic apparatus.

2. Related Art

A droplet discharge device discharging a functional liquid as droplets from a head to apply the droplets on a workpiece, for example, includes the head to discharge the functional liquid as the droplets, a stage to place the workpiece, a maintenance unit to regulate or recover a droplet discharge property of the head, head moving means to move the head between the stage and the maintenance unit, and a controller to control these operations. The head is set to face a region of the workpiece, and then a driving voltage for discharging droplets is applied to the head so as to make it a driven state. As a result, the droplets are discharged from the head to the region serving as a discharged region. In the device, if it is necessary to regulate or recover the droplet discharge property of the head, or to temporarily stop the discharge operation, driving the head is once stopped and held in a waiting state, during which the head is regulated or recovered. Upon completion of the process, the head is driven again to discharge droplets. Refer to JP-A-2004-209429.

In this regard, the temperature of the functional liquid may differ in a state where the head is provided. This is because, for example, in a case where the head is set in a waiting state to regulate the droplet discharge property of the head, and in another case where the head is in a driven state while discharging droplets to the workpiece, heat caused by driving the head is differently transferred to the functional liquid inside the head between the cases. Accordingly, the viscosity of the functional liquid differs between the waiting and the driven states of the head. This causes a problem in that a desired droplet amount is not obtained in the head driven state if a driving voltage calculated based on a droplet amount measured in a waiting state of the head for regulating the liquid discharge property of the head is applied to the head in the driven state without change. Because the viscosity change of the functional liquid due to the temperature change of the functional liquid is not taken into consideration in calculating the driving voltage, resulting in the discharged droplet amount being changed in the head driven state.

SUMMARY

The invention is proposed in order to solve the above-mentioned problems and can be achieved as the following aspects.

According to a first aspect of the invention, a droplet discharge device includes: a head driven to discharge a functional liquid as a droplet; a driving voltage generation unit that generates a driving voltage to drive the head; a first temperature acquisition unit to acquire a temperature of the functional liquid in the head as a first temperature in a case where the head is in a head waiting state in which the head is waited; a second temperature acquisition unit to acquire a temperature of the functional liquid in the head as a second temperature in a case where the head is in a head driven state in which the head is driven; a temperature difference computing unit that computes a temperature difference between the first temperature and the second temperature; and a driving voltage correction unit that corrects the driving voltage based on the temperature difference. The driving voltage generation unit generates the corrected driving voltage to the head in a case where the head is in the head driven state.

In the device, the temperatures of the functional liquid in the head waiting state and the head driven state are acquired, and the temperature difference of the functional liquid in the both head states is computed. Based on the computed temperature difference of the functional liquid, the driving voltage is corrected, and the corrected voltage is generated in the head driven state. Consequently, a desired liquid amount can be discharged in the head driven state even if the functional liquid shows different temperatures depending on a state in which the head is provided since the driving voltage in the head driven state is corrected in accordance with the temperature difference.

In the device, the first temperature acquisition unit preferably acquires a temperature of the head as the first temperature if the head is in the head waiting state instead of the temperature of the functional liquid. The second temperature acquisition unit preferably acquires a temperature of the head as the second temperature if the head is in the head driven state instead of the temperature of the functional liquid. The temperature difference computing unit preferably computes a temperature difference between the first and second temperatures of the head.

Since the temperature of the head is used as a substitute for that of the functional liquid, the temperature can be readily acquired. In addition, the device structure also can be simplified.

The device may further include a driving voltage acquisition unit that acquires a reference driving voltage serving as a reference to discharge a desired droplet amount in the head driven state by applying the driving voltage to the head in the head waiting state. The driving voltage correction unit preferably corrects the reference driving voltage based on the temperature difference.

According to the device, a desired droplet amount can be discharged in the head driven state since a driving voltage necessary to obtain the desired droplet amount in the head driven state is acquired as a reference driving voltage in the head waiting state, and the reference driving voltage is corrected based on the temperature difference. In related art, there may be the following problems. In the head driven state, a driving voltage is applied to the head so as to discharge a desired droplet amount. In the head driven state, the desired droplet amount is stably discharged since the temperature of the head or the temperature of the functional liquid in the head is approximately constant. The head temperature or the temperature of the functional liquid in the head, however, is changed in a case where the device proceeds to a maintenance process in order to measure the droplet amount, and the like, that is, to the head waiting state from the head driven state because the state is changed in which the head is provided. In this regards, if the following manner is applied, a desired droplet amount may not be obtained in the head driven state. First, the desired droplet amount is measured in the head waiting state (droplet amount measuring time). Then, a driving voltage applied to the head in order to obtain the desired droplet amount is applied as the driving voltage in the head driven state without change. In this manner, the head temperature or the temperature of the functional liquid in the head is changed (the viscosity of the functional liquid is changed) in the transitional process from the head waiting state to the head driven state. In contrast, in the invention, a driving voltage in order to obtain a desired droplet amount is acquired in the head waiting state as the reference driving voltage. The reference driving voltage is corrected based on the temperature difference in the head temperature or the temperature of the functional liquid in the head. That is, the corrected driving voltage is applied in the head driven state. The driving voltage acquired in the head waiting state in order to obtain the desired droplet amount is not applied to the head driven state without change. As a result, a desired droplet amount can be discharged from the head in the head driven state even if the head temperature is changed since the state is changed in which the head is provided.

The device may further include: a first droplet amount acquisition unit that acquires a first droplet amount discharged from the head by applying the reference driving voltage used in the head driven state to the head in the head waiting state; a second droplet amount acquisition unit that acquires a desired second droplet amount in the head driven state; and a droplet amount difference computing unit that computes a droplet amount difference between the first droplet amount and the second droplet amount. The driving voltage correction unit preferably corrects the reference driving voltage based on the droplet amount difference and the temperature difference.

In the device, the driving voltage used in the head driven state is applied in the head waiting state, and the droplet amount discharged from the head is acquired as the first droplet amount. The droplet amount difference between the first droplet amount and the second droplet amount is computed. The second droplet amount is a desired droplet amount discharged in the head driven state. In addition, the temperature difference between the head waiting state and the head driven state is acquired, and the temperature difference is computed. Based on the droplet amount difference and the temperature difference, the driving voltage applied in the head waiting state is corrected. The corrected driving voltage is applied to the head in the head driven state. As a result, a desired droplet amount can be discharged from the head in the head driven state. In related art, there may be the following problems. In the head driven state, a driving voltage is applied to the head so as to discharge a desired droplet amount. In the head driven state, the desired droplet amount is stably discharged since the temperature of the head or the temperature of the functional liquid in the head is approximately constant. The head temperature or the temperature of the functional liquid in the head, however, is changed in a case where the device proceeds to a maintenance process in order to measure the droplet amount, and the like, that is, to the head waiting state from the head driven state because the state is changed in which the head is provided. In this case, in the head waiting state (droplet amount measuring time), a desired droplet amount cannot be obtained by applying the driving voltage in the head driven state to the head. Thus, even if the driving voltage is applied in the head driven state, the desired droplet amount may not be obtained in the head driven state since the head temperature or the temperature of the functional liquid in the head is changed in the transitional process from the head waiting state to the head driven state. The driving voltage in the head driven state needs to be regulated taking into consideration a droplet discharge property change due to the aging deterioration of the head (e.g., a head deformation). In contrast, in the invention, the driving voltage in the head driven state is corrected based on the droplet amount difference and the temperature difference. As a result, the desired droplet amount can be discharged from the head in the head driven state.

In the device, the head may be positioned in an area excluding a region of a workpiece, and the region is coated with the droplet discharged from the head.

According to the device, maintenance processes and the like are conducted in the area excluding the region of the workpiece. As a result, the workpiece is not coated with unwanted or unnecessary droplets.

In the device, the driving voltage correction unit preferably selects one piece of correction data of the driving voltage out of a plurality of pieces of correction data of the driving voltage, and the one piece of the correction data corresponds to the temperature difference.

In the device, correction values can readily be obtained from the computed temperature differences.

In the device, the driving voltage correction unit preferably selects one correction constant of the driving voltage out of a plurality of correction constants of the driving voltage, and the one correction constant corresponds to the temperature difference.

In the device, correction values can readily be obtained from the computed temperature differences.

In the device, the driving voltage generation unit preferably generates the driving voltage of an about a threshold level by which the droplet is not discharged from the head in a transitional period from the head waiting state to the head driven state.

The head state can stably proceed from the state in which the head is not driven to the state in which the head is driven.

According to a second aspect of the invention, a method for discharging a droplet of a functional liquid by driving a head includes: applying a driving voltage to the head in a head waiting state in which the head is waited so as to acquire a reference driving voltage serving as a reference to discharge a desired droplet amount in a head driven state in which the head is driven; acquiring a first temperature of the head in the head waiting state; acquiring a second temperature of the head in the head driven state; computing a temperature difference between the first temperature and the second temperature; correcting the reference driving voltage based on the temperature difference; and generating the corrected driving voltage to the head in the head driving state.

According to the method, first, the driving voltage necessary to be applied to the head in order to obtain the desired droplet amount in the head driven state is acquired. The driving voltage is set as the reference driving voltage. The temperatures of the head in the head waiting state and the head driven state are acquired, and then the difference between the acquired temperatures is computed. Based on the computed head temperature difference, the reference driving voltage is corrected so as to generate the corrected driving voltage as the driving voltage in the head driven state. As a result, a desired droplet amount can be discharged from the head in the head driven state even if the head temperature is changed since the state is changed in which the head is provided.

According to a third aspect of the invention, a method for discharging a droplet of a functional liquid by driving a head includes: applying a reference driving voltage used in a head driven state in which the head is driven, in a head waiting state in which the head is waited, so as to acquire a first droplet amount discharged from the head; acquiring a first temperature of the head in the head waiting state; acquiring a desired second droplet amount in the head driven state; acquiring a second temperature of the head in the head driven state; computing a droplet amount difference between the first droplet amount and the second droplet amount; correcting the reference driving voltage based on the droplet amount difference and the temperature difference; and generating the corrected driving voltage to the head in the head driving state.

According to the method, for example, a reference driving voltage (e.g., a driving voltage in the head driven state) is applied to the head in the head waiting state (droplet measuring time). The resulting droplet amount is acquired as the first droplet amount. Then, a desired droplet amount in the head driven state is acquired as the second droplet amount. The difference between the first droplet amount and the second droplet amount is computed. The resulting difference is acquired as the droplet amount difference. The temperatures of the head in the head waiting state and the head driven state are acquired, and then the difference between the acquired temperatures is computed. The resulting difference is acquired as the head temperature difference. Based on the droplet amount difference and the head temperature difference, the reference driving voltage is corrected so as to generate the corrected driving voltage as the driving voltage in the head driven state. As a result, a desired droplet amount can be discharged in the head driven state. In addition, an adequate driving voltage can be generated taking into a droplet discharge property change due to the aging deterioration of the head.

According to a fourth aspect of the invention, a method for forming a pattern includes forming the pattern to a workpiece with the droplet discharged by the method for discharging a droplet according to the second aspect.

According to the method, a pattern can be formed with a reduced variation in the coated thickness and a reduced occurrence of incomplete coatings.

According to a fifth aspect of the invention, a pattern formed member includes a pattern formed on the workpiece by the method for forming a pattern according to the fourth aspect.

As a result, the pattern formed member can be formed with a reduced variation in the coated thickness and a reduced occurrence of incomplete coatings. The pattern formed member includes color filters, organic EL members, and field emission display (FED) members.

According to a sixth aspect of the invention, an electro-optical device includes the pattern formed member according to the fifth aspect.

The electro-optical device can include the pattern formed member having high reliability. The electro-optical device includes liquid crystal displays, organic EL displays, and field emission displays (FEDs).

According to a seventh aspect of the invention, an electronic apparatus includes the electro-optical device according to the sixth aspect.

The electronic apparatus can include the electro-optical device having high reliability. The electronic apparatus includes television receivers, personal computers, and other electronic products that are provided with color filters, organic EL displays, and field emission displays (FEDs).

BRIEF DESCRIPTION OF THE DRAWINGS

The invention will be described with reference to the accompanying drawings, wherein like numbers reference like elements.

FIG. 4 is an explanatory view of the temperature change of the head.

FIGS. 5A and 5B are explanatory views of a driving voltage.

DESCRIPTION OF EXEMPLARY EMBODIMENTS

Figure 1:
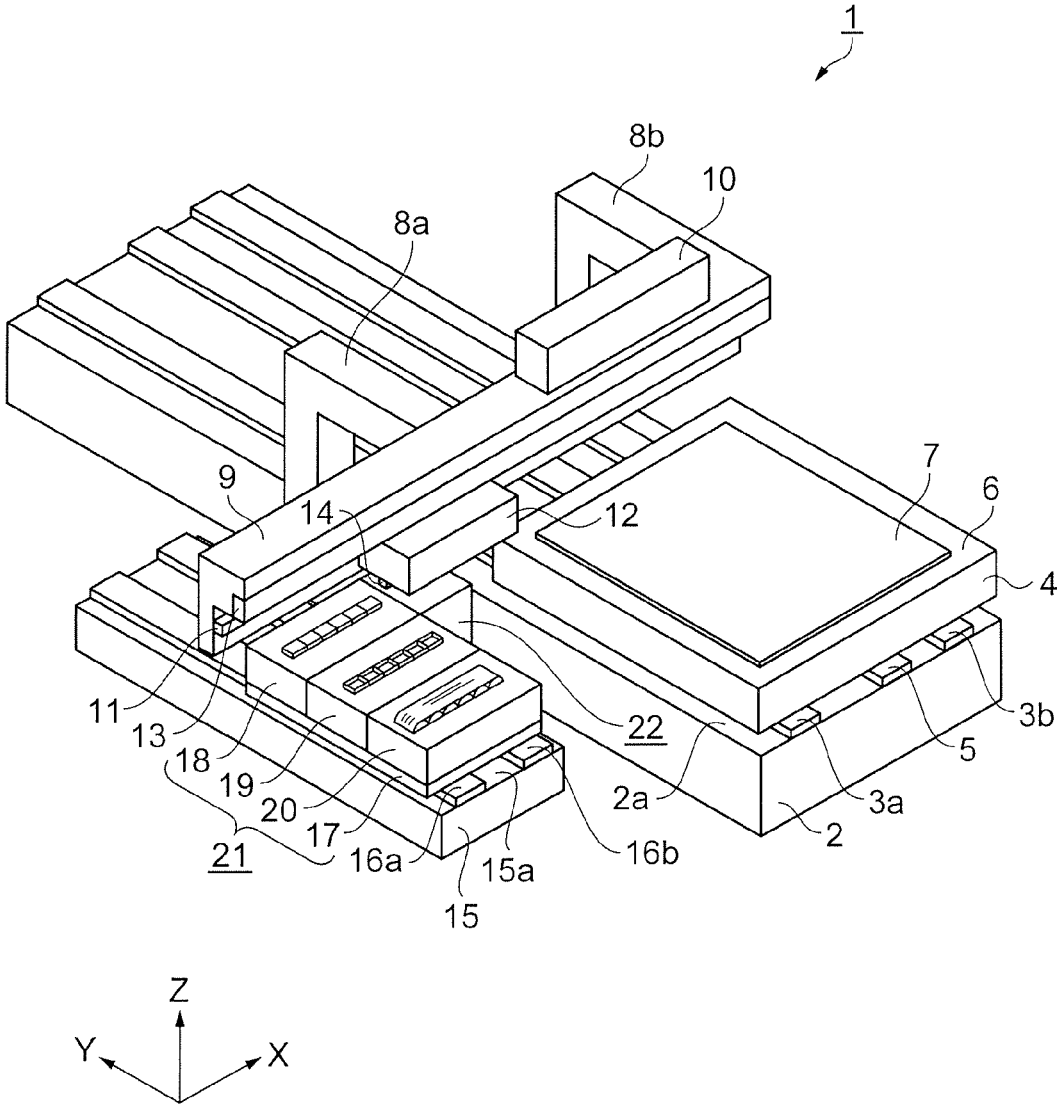
FIG. 1 is an outline view schematically showing a droplet discharge device.

Hereinafter, embodiments of the invention are described with reference to the accompanying drawings. The scales of members in the drawings are adequately changed so that they can be recognized.

First Embodiment

Droplet Discharge Device

First, a droplet discharge device is described. There are various kinds of droplet discharge devices, but a device employing an inkjet method is representatively described. The droplet discharge device employing the inkjet method allows discharging fine droplets, so that it is preferable for a fine processing.

FIG. 1 is an outline view schematically showing a structure of the droplet discharge device 1. The droplet discharge device 1 discharges a functional liquid to apply droplets to a substrate 7 serving as a workpiece. As shown in FIG. 1, the droplet discharge device 1 includes a rectangular parallelepiped base 2. In the embodiment, a longitudinal direction of the base 2 is denoted as a Y direction and a direction perpendicular to the Y direction is denoted as an X direction.

On an upper surface 2*a* of the base 2, a pair of guide rails 3*a* and 3*b* is provided in a projected manner along a whole width of the base 2 in the Y direction. Above the base 2, a stage 4 is attached. The stage 4 serves as a scanning unit having a linear moving mechanism that is not shown and corresponds to the pair of guide rails 3*a* and 3*b*. The linear moving mechanism of the stage 4 is a screw-type linear moving mechanism including a screw shaft (a driving shaft) extending along the guide rails 3*a* and 3*b* in the Y direction and a ball nut that is screwed together with the screw shaft. The driving shaft is coupled to a Y-axis motor (not shown) that receives a predetermined pulse signal to rotate normally or reversely at a unit step. If a driving signal that corresponds to the predetermined number of steps is inputted into the Y-axis motor, the Y-axis motor rotates normally or reversely at a predetermined velocity so as to move the stage 4 forward or rearward along the Y direction (scanning in the Y direction) by an amount correspondingly to the predetermined number of steps.

In addition, on the upper surface 2*a* of the base 2, a main scanning position detecting device 5 is disposed in parallel to the guide rails 3*a* and 3*b*, so that a position of the stage 4 can be measured.

On an upper surface of the stage 4, a placing surface 6 is formed. The placing surface 6 includes a suction type substrate chuck mechanism that is not shown. When the substrate 7 is placed on the placing surface 6, the substrate chuck mechanism positions and fixes the substrate 7 at a predetermined position of the placing surface 6.

At the both sides of the base 2 in the X direction, a pair of supporting stands 8*a* and 8*b* is provided and a guide member 9 is provided extending in the X direction in a straddling manner between the pair of supporting stands 8*a* and 8*b*. The width of the guide member 9 in the X direction is shorter than that of the stage 4 in the X direction so that an end of the guide member 9 is overhung from the supporting stand 8*a*.

On an upper surface of the guide member 9, a storage tank 10 is provided. The storage tank 10 can store and supply a functional liquid to be discharged. On the other hand, under the guide member 9, a guide rail 11 is formed extending in whole width of the guide member 9 along the X direction in a projected manner.

A carriage 12 disposed movably along the guide rail 11 is formed in an approximately rectangular parallelepiped shape. The linear moving mechanism of the carriage 12 is similar to that included in the stage 4. If a driving signal that corresponds to a predetermined number of steps is inputted into the X-axis motor included in the carriage 12, the X-axis motor rotates normally or reversely so as to move the carriage 12 forward or rearward along the X direction (scanning in the X direction) by an amount correspondingly to the predetermined number of steps. On the bottom surface of the carriage 12 (a surface facing the stage 4), a head 14 is provided in a projected manner.

A maintenance base 15 is disposed at a side adjacent to one side (opposite direction of the X direction in FIG. 1) of the base 2. On an upper surface 15*a* of the maintenance base 15, a pair of guide rails 16*a* and 16*b* is provided in a projected manner along a whole width of the base 15 in the Y direction. Above the maintenance base 15, a maintenance stage 17 is attached. The maintenance stage 14 serves as a scanning unit having a linear moving mechanism that is not shown and corresponds to the pair of guide rails 16*a* and 16*b*. The linear moving mechanism of the maintenance stage 17 is the similar to that included in the stage 4, and moves forward or rearward along the Y direction.

On the maintenance stage 17, a flushing unit 18, a capping unit 19, and a wiping unit 20 are disposed. The flushing unit 18 receives droplets that are discharged from the head 14 when a flow channel in the head 14 is cleaned. In a case where a solid matter enters the head 14, the head 14 discharges droplets so as to remove the solid matter therefrom and clean the head 14. The flushing unit 18 receives the droplets. The embodiment arranges six saucers, so that 6 droplet heads 14 can discharge droplets to the flushing unit 18.

The capping unit 19 lids the head 14. The droplets discharged from the head 14 are sometimes volatile. If a solvent of a functional liquid stored in the head 14 is vaporized from a nozzle, the viscosity of the functional liquid varies, sometimes causing a clog of the nozzle. The capping unit 19 lids the head 14 so as to prevent the nozzle from clogging.

The wiping unit 20 wipes a nozzle plate, on which the nozzle is disposed, of the head 14. The nozzle plate is disposed on a surface facing the substrate 7 of the head 14. If droplets are attached to the nozzle plate, the droplets attached to the nozzle plate make contact with the substrate 7, sometimes causing an attachment of the droplets to an unexpected position in the substrate 7. The wiping unit 20 wipes the nozzle plate so as to prevent the droplets from attaching to an unexpected position of the substrate 7.

The maintenance stage 17 moves along the guide rails 16*a* and 16*b* so as to dispose any one of the flushing unit 18, the capping unit 19, and the wiping unit 20 at a position opposing the head 14. The flushing unit 18, the capping unit 19, and the wiping unit 20 are included in a head cleaning section 21.

A droplet weight measuring device 22 is disposed between the maintenance base 15 and the base 2. The droplet weight measuring device 22 is provided with two electronic balances each include a saucer. The electronic balances measure the weight of the droplets that are discharged from the head 14 to the saucers. The saucers each include a sponge-like absorber, so that the droplets are prevented from splashing and flying out of the saucers.

The carriage 12 moves along the guide rail 11 in the X direction and the head 14 moves to a position opposing the head cleaning section 21, the droplet weight measuring device 22, or the substrate 7 so as to discharge droplets.

The flashing unit 18, the capping unit 19, the wiping unit 20, and the droplet weight measuring device 22 serve as a maintenance device to regulate, adjust, or recover the discharge property of droplets discharged from the head 14. The head 14 also moves from a droplet discharged region of the substrate 7 to be positioned at a region out of the substrate 7 for being subjected to various maintenance processes in the maintenance device.

Figure 2:
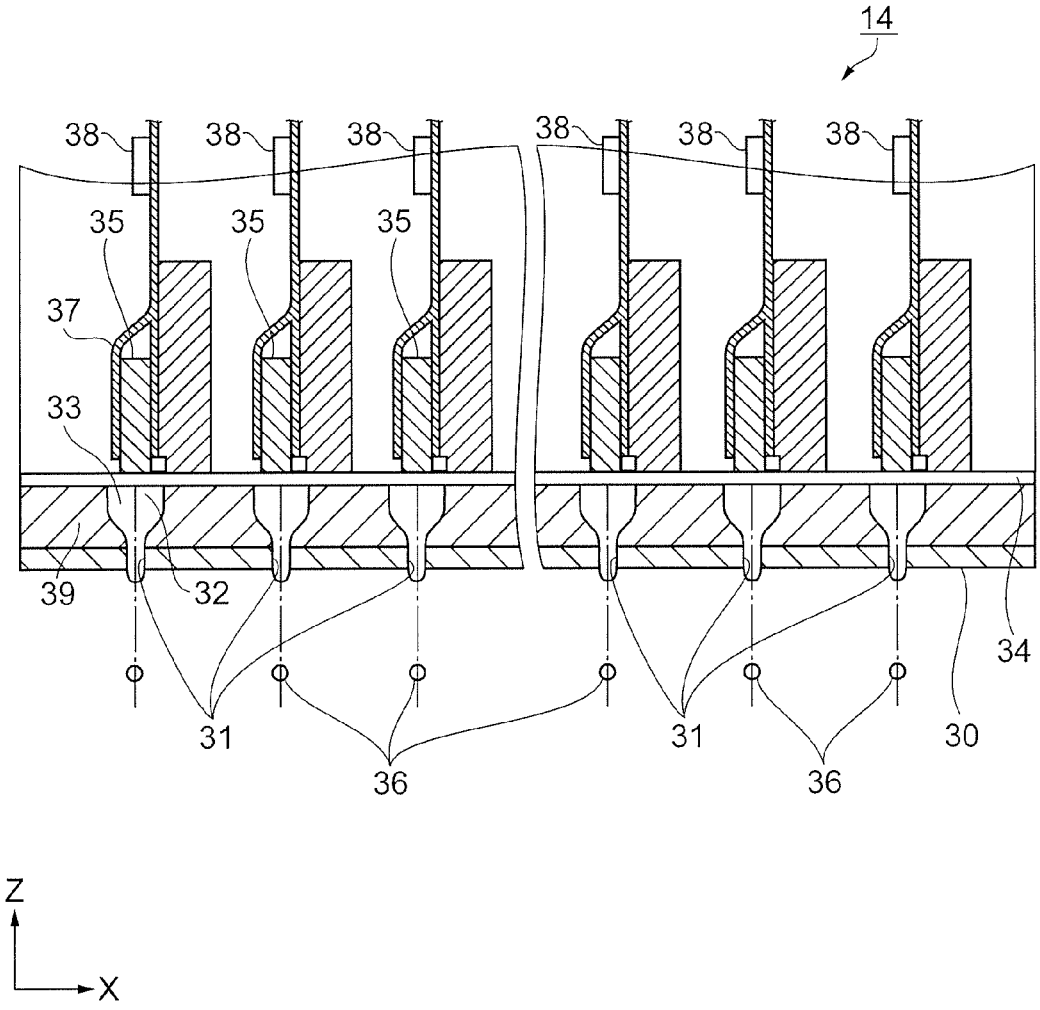
FIG. 2 is a major schematic perspective view of a head.

FIG. 2 is a major sectional view to describe the structure of the head 14 discharging droplets. As shown in FIG. 2, the head 14 is provided with a nozzle plate 30 having nozzle orifices 31. A flow channel formed substrate 39 in which flow channels of a functional liquid of a functional liquid 33 are formed is disposed on one side surface of the nozzle plate 30 and adhesively bonded to the nozzle plate 30. The flow channel formed substrate 39 has pressure generation chambers 32 that are formed at positions opposing the nozzle orifices 31 and communicate with the nozzle orifices 31.

On the upper side of the pressure generation chamber 32, a vibration plate 34 and a piezoelectric element 35 that serves as a pressurizing element are provided. The vibration plate 34 vibrates along an up-down direction (in a Z direction) to increase and decrease the volume of the pressure generation chamber 32. The piezoelectric element 35 elongates and contracts along the up-down direction to vibrate the vibration plate 34.

The piezoelectric element 35 is coupled to a circuit substrate 37 that supplies a signal for driving the piezoelectric element 35. The circuit substrate 37 is coupled to a driving element 38 to control driving the piezoelectric element 35. In addition, the circuit substrate 37 is coupled to a wiring substrate (not shown) including a circuit to generate the driving signal.

In order to discharge the functional liquid 33 charged in the pressure generation chambers 32 as droplets, the volumes of the pressure generation chambers 32 are changed by deforming the piezoelectric elements 35 and the vibration plates 34 so as to discharge droplets 36 from predetermined nozzle orifices 31. Specifically, a driving voltage is applied to the piezoelectric element 35 to contract the piezoelectric element 35. The vibration plate 34 is deformed together with the piezoelectric element 35 to expand the volume of the pressure generation chamber 32. As a result, the functional liquid 33 is drawn into the pressure generation chamber 32. After the functional liquid is internally charged up to the nozzle orifice 31, the voltage applied to the piezoelectric element 35 is released in accordance with a record signal supplied through the wiring substrate. This release results in the piezoelectric element 35 being elongated to recover to the original state. At the same time, the vibration plate 34 is also deformed to recover to the original state. As a result, the volume of the pressure generation chamber 32 is decreased to increase the pressure inside the pressure generation chamber 32, discharging the functional liquid 33 from the nozzle orifice 31 as the droplet 36.

Figure 3:
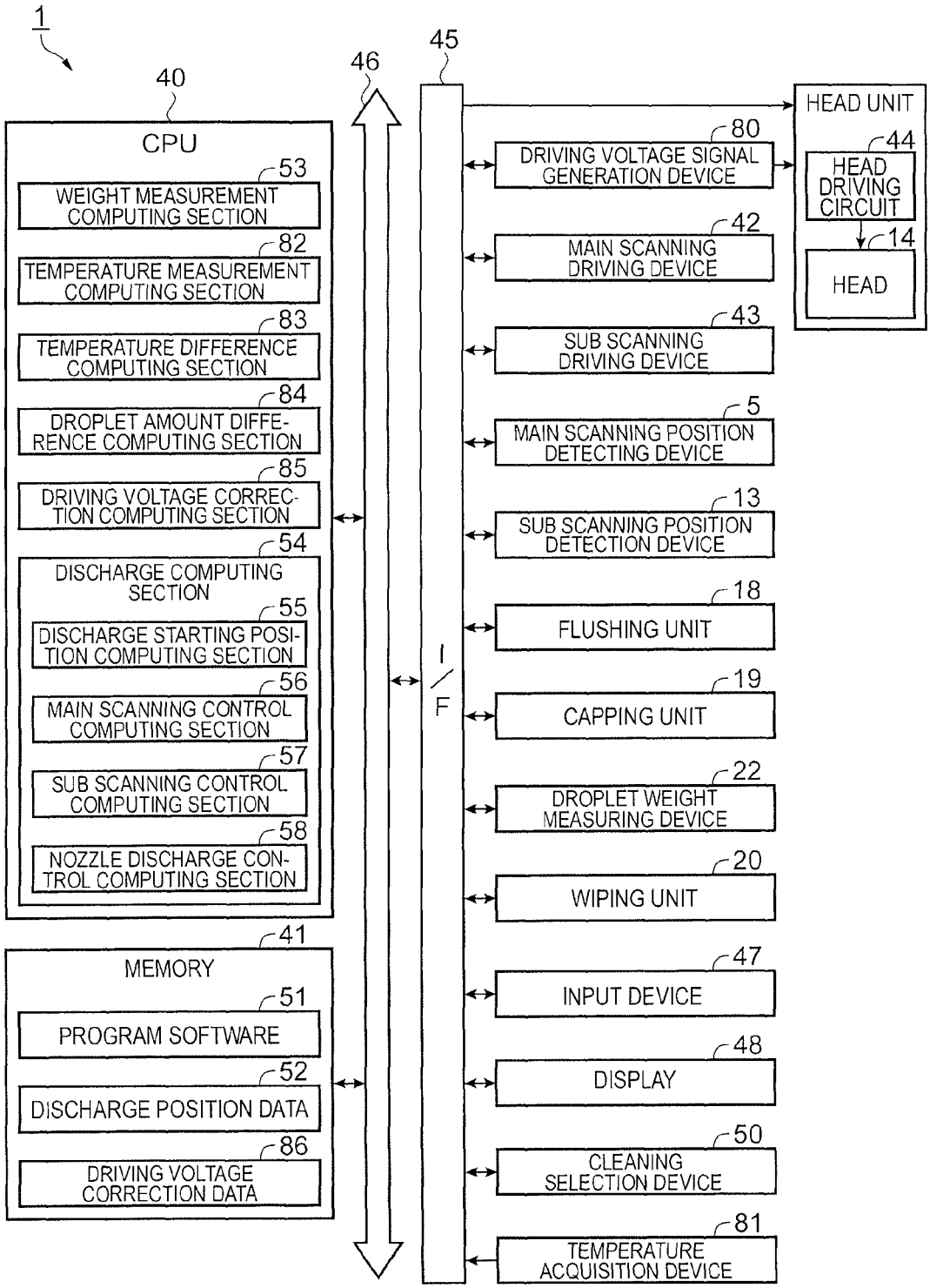
FIG. 3 is a block diagram showing an electric control of the droplet discharge device.

FIG. 3 is a block diagram showing an electric control of the droplet discharge device 1. Referring to FIG. 3, the droplet discharge device 1 includes a central processing unit (CPU) 40 that executes various pieces of processing as a processor, and a memory 41 that stores various pieces of information.

A main scanning driving device 42, a sub scanning driving device 43, a main scanning position detection device 5, and a sub scanning position detection device 13 are coupled to the CPU 40 through an input-output interface 45 and a bus 46. A head driving circuit 44 to control driving a driving voltage signal generation device 80 and the head 14, and a temperature acquisition device 81 are also coupled to the CPU 40 through the input-output interface 45 and the bus 46. In addition, an input device 47, a display 48, the droplet weight measuring device 22, the flushing unit 18, the capping unit 19, and the wiping unit 20 are also coupled to the CPU 40 through the input-output interface 45 and the bus 46. Likewise, in the head cleaning section 21, a cleaning selection device 50 selecting one of the units is also coupled to the CPU 40 through the input-output interface 45 and the bus 46.

The main scanning driving device 42 controls a move of the stage 4 while the sub scanning driving device 43 controls a move of the carriage 12. The main scanning position detection device 5 recognizes a position of the stage 4 and the main scanning driving device 42 controls the move of the stage 4, so that the stage 4 can be moved to and stopped at a desired position. In the same manner, the sub scanning position detection device 13 recognizes a position of the carriage 12 and the sub scanning driving device 43 controls the move of the carriage 12, so that the carriage 12 can be moved to and stopped at a desired position.

The input device 47 inputs various processing conditions for discharging droplets. For example, the input device 47 receives and inputs coordinates for discharging droplets to the substrate 7 from an external device not shown. The display 48 displays processing conditions and operating states. An operator executes operations by using the input device 47 based on information displayed on the display 48.

The droplet weight measuring device 22 includes a saucer and an electric balance, and measures the weight of the saucer that receives droplets discharged from the head 14. The electronic balance measures the weight of the saucer before and after the droplets are discharged so as to send measured values to the CPU 40.

The cleaning selection device 50 selects one out of the flushing unit 18, the capping unit 19, and the wiping unit 20 included in the head cleaning section 21, and moves it to a position opposing the head 14.

The temperature acquisition device 81 measures the temperature of the head 14. The temperature acquisition device 81 includes a thermocouple having a temperature sensing section sensing temperature, and a wiring section electrically coupling the temperature sensing section and a temperature detection circuit. As the temperature acquisition device 81, an infrared radiation temperature acquisition device may be employed that acquires temperature by converting received light energy of infrared rays emitted from the head 14 into temperature.

The memory 41 includes a semiconductor memory such as RAMs and ROMs, and an external memory device such as hard disks and CD-ROMs. In a functional point of view, a storage area to store a program software 51 including control procedures of the operation in the droplet discharge device 1, and another storage area to store discharge position data 52 of coordinate data of discharge positions in the substrate 7 are set in the memory 41. In addition, still another storage area is set to store driving voltage correction data 86 for correcting the driving voltage. The driving voltage correction data 86 is described in detail later. Furthermore, the memory 41 has a storage area for storing a main scanning moving amount of the substrate 7 moved in the main scanning direction (the Y direction) and a sub scanning moving amount of the carriage 12 moved in the sub scanning direction (the X direction), a storage area serving as a work area or a temporary file for the CPU 40, and other various storage areas.

The CPU 40 controls to discharge the functional liquid as droplets to a predetermined position on the surface of the substrate 7 in accordance with the program software 51 stored in the memory 41. Specifically, as practical functional sections, the CPU 40 includes a weight measurement computing section 53 to compute for realizing a droplet weight measurement using the droplet weight measuring device 22, a temperature measurement computing section 82 to compute for realizing a temperature measurement of the head 14 or the like by using the temperature acquisition device 81, a droplet amount difference computing section 84 to perform a subtraction of data computed by the weight measurement computing section 53, a temperature difference computing section 83 to perform a subtraction of data computed by the temperature difference computing section 82, a driving voltage correction computing section 85 to compute a correction of the driving voltage, and a discharge computing section 54 to compute for discharging droplets by the head 14.

Particularly, the discharge computing section 54 includes a discharge starting position computing section 55 for setting the head 14 at an initial position to discharge droplets. Further, the discharge computing part 54 includes a main scanning control computing section 56 that controls to move the substrate 7 along the main scanning direction (the Y direction) at a predetermined velocity as a scanning. In addition, the discharge computing section 54 includes a sub scanning control computing section 57 that computes a control to move the head 14 in the sub scanning direction (the X direction) by a predetermined sub scanning moving amount. Further, the discharge computing section 54 includes various kinds of functional computing sections such as a nozzle discharge control computing section 58 that compute to control which nozzle is operated to discharge the functional liquid out of a plurality of nozzles in the head 14.

The temperature change of the functional liquid is described below. This is one of the main points of the invention. FIG. 4 is a view to describe the temperature change of the head 14 in a head waiting(standby) state and a head driven state. The head waiting(standby) state shows that the head 14 is temporarily not driven or under maintenance in a case where it is necessary to regulate, adjust, and recover (conduct maintenance) the droplet discharge property or to stop the discharging operation temporarily. The head driven state shows that the head 14 continues to discharge droplets 36 to the substrate 7.

FIG. 4 shows the head waiting state and the head driven states on the abscissa axis while a head temperature T on the ordinate axis. In the embodiment, the temperature of the head 14 is used as a substitute of the temperature of the functional liquid 33. Because, it is difficult to directly measure the temperature of the functional liquid 33, and the temperature change of the functional liquid 33 in the head 14 and the temperature change of the head 14 are correlated. Of course, the temperature of the functional liquid may be directly measured.

As shown in FIG. 4, the temperature of the head 12 continues at a substantially constant temperature T1 in a period P1 of the head waiting state. The temperature of the head 14 continues at a substantially constant temperature T2 in a period P2 of the head driven state. There is a temperature difference Δt of the temperature of the head 14 between the period P1 in the head waiting state and P2 in the head driven state. This difference is due to the state of the head 14, more in detail, due to the difference of driving states of the head 14. For example, in the head driven state, the head 14 continues to discharge the droplets 36 to the substrate 7. Meanwhile, a driving voltage is applied to the head 14 to discharge the droplets 36. In this regard, for example, a driving voltage having a discharge drive wave form 62 shown in FIG. 5A is applied to the head 14. The discharge drive waveform 62 has an approximate trapezoid shape. A discharge voltage 63 that is a peak value of the driving voltage at discharging is set to be a predetermined voltage, and is applied for a predetermined time. The applied voltage causes the wiring substrate, the circuit substrate 37, and driving element 38 to generate heat. The generated heat rises the temperature of the functional liquid 33 in the head 14. In addition, the movement of the piezoelectric element 35 that is driven is also converted into heat, resulting in the temperature of the functional liquid 33 in the head 14 being increased. As the temperature of the functional liquid 33 increases the temperature of the head 14 also increases.

In contrast, in the head waiting state, for example, in maintenance processes, the number of times or hours to drive the head 14 is less than that in the head driven state. Thus, the heat generated from the wiring substrate, the circuit substrate 37, and the driving element 38, and heat converted from the operation of the piezoelectric element 35 are less than those in the head driven state. The temperature of the head 14 in the head waiting state tends to show a lower temperature than the temperature T2 of the head 14 in the head driven state.

Accordingly, the temperature of the functional liquid 33 differs in the head waiting state and the head driven state. In other words, the viscosity of the functional liquid 33 differs in the respective states of the head. This difference causes the following problem. For example, if a driving voltage calculated based on a droplet amount measured under the head waiting state is applied to the head in the head driven state, the viscosity of the functional liquid 33 is changed due to a temperature change (in FIG. 4, the viscosity of the functional liquid 33 in the head driven state is lower than that in the head waiting state). This viscosity change results in the discharged droplet amount in the head driven state being changed. Consequently, a desired droplet amount cannot be obtained. In order to solve the setback, a corrected driving voltage is applied in the head driven state. Hereinafter, the details are described.

Droplet Discharge Method

Figure 6:
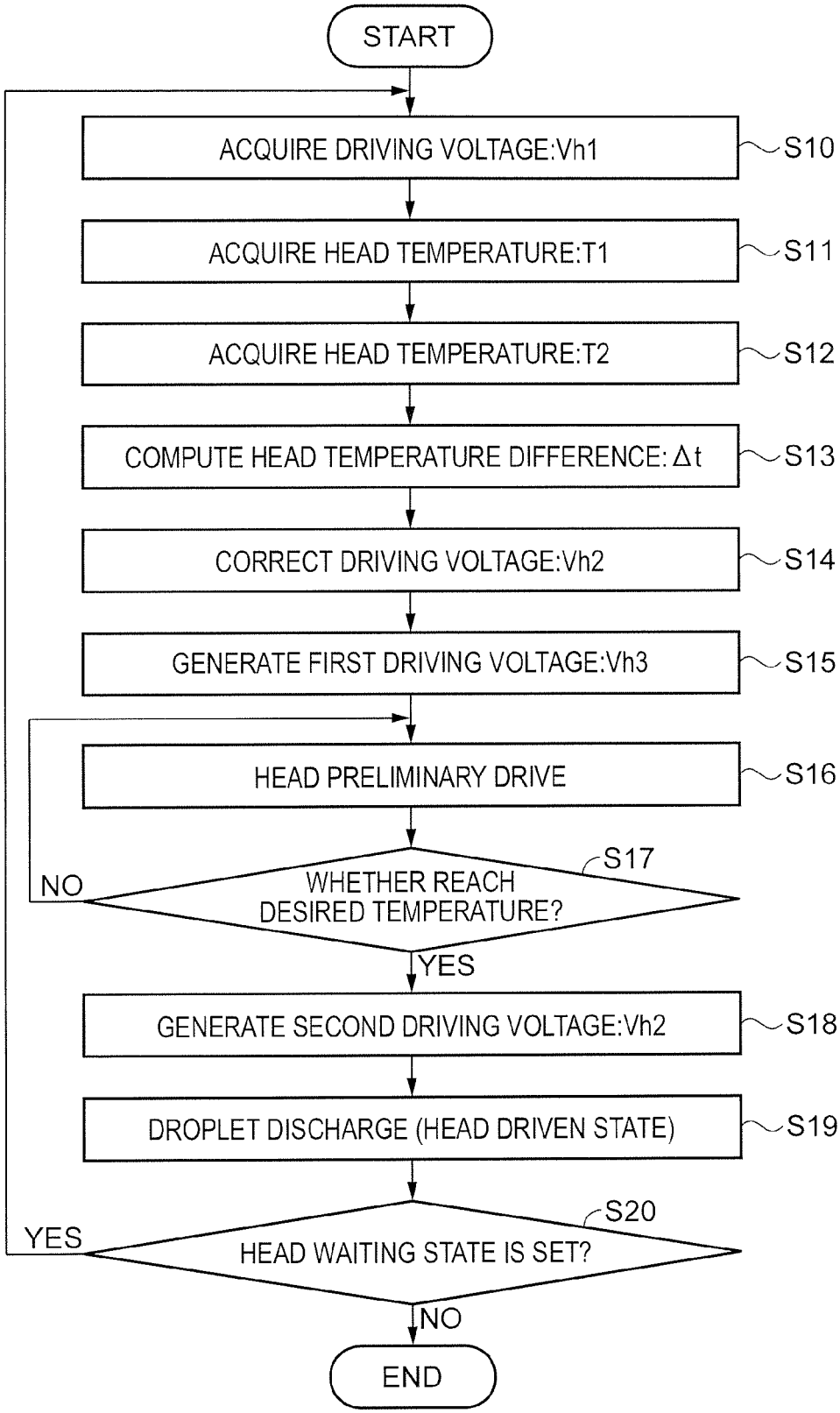
FIG. 6 is a flow chart showing a method for discharging a droplet in a first embodiment.
Figure 7:
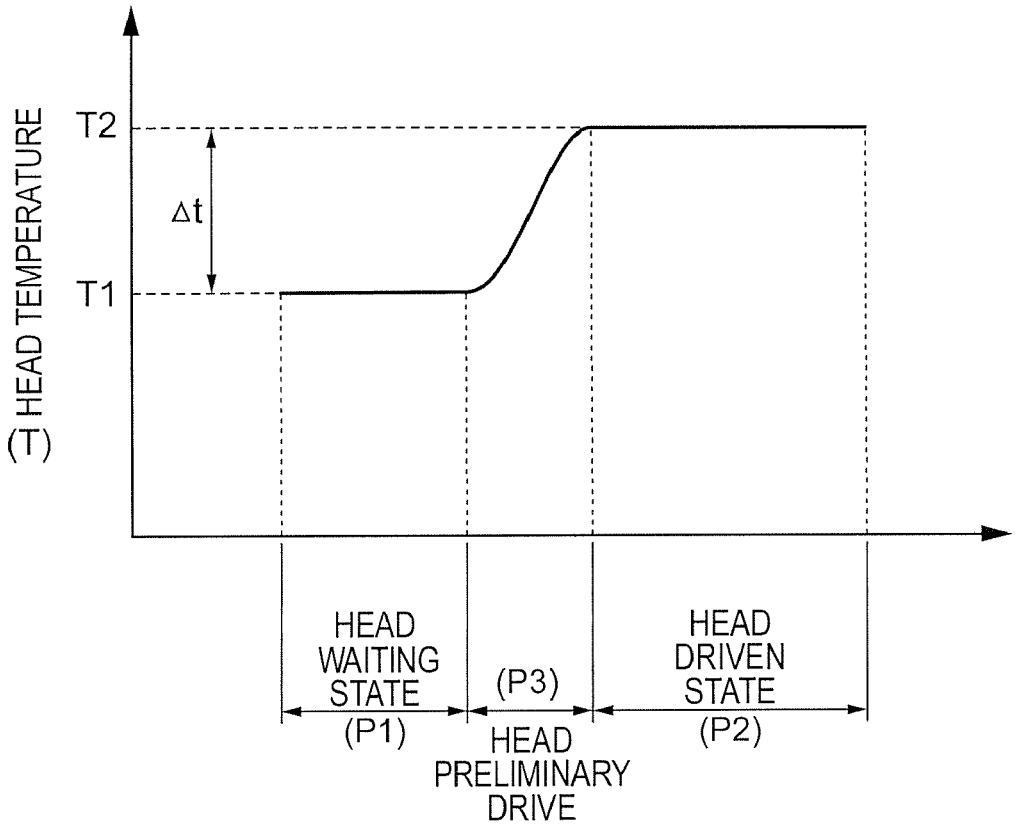
FIG. 7 is an explanatory view of the temperature change of the head in the method for discharging a droplet.

A method for discharging a droplet in the embodiment is described with reference to FIG. 6 and FIG. 7. FIG. 6 is a flow chart showing a method for discharging a droplet in the embodiment. FIG. 7 is a view showing the temperature change of the head 14 in the method for discharging a droplet of the embodiment.

A step S10 is a driving voltage acquisition step. In the step, a driving voltage is acquired as a reference to apply a driving voltage to the head 14 in the head waiting state and to discharge a desired droplet amount in the head driven state. Specifically, for example, in the head waiting state (period P1) in FIG. 7, a driving voltage is applied to the head 14 in order to obtain a desired droplet amount in the head driven state (period P2). The driving voltage by which the desired droplet amount has been obtained is acquired as a driving voltage Vh1 serving as a reference.

A step S11 is a first temperature acquisition step in which a first temperature of the head 14 in the head waiting state is acquired. Specifically, for example, in a state (period P1) in which the head 14 moves to a position opposing the droplet weight measuring device 22, the temperature of the head 14 is acquired as a first temperature T1 (e.g., 25° C.). The temperature of the head 14 is measured by the temperature acquisition device 81. A position to measure the temperature of the head 14 can be arbitrarily selected taking into consideration a position at which the correlation can be obtained with the temperature change of the functional liquid 33. For example, a surface of the nozzle plate 30 or the vicinity thereof, a side surface of the head 14, may be selected.

A step S12 is a second temperature acquisition step in which a second temperature of the head 14 in the head driven state is acquired. For example, the temperature of the head 14 under a state (period P2) in which the head 14 discharges the functional liquid 33 while being positioned at a discharged region of the substrate 7 is acquired as a second temperature T2 (e.g., 27° C.). The temperature of the head 14 can also be measured by the temperature acquisition device 81 in the same manner of the step S12. Alternatively, a known temperature acquired in setting conditions in the head driven state may be employed as the second temperature T2.

A step S13 is a temperature difference computing step in which the temperature difference Δt between the first temperature T1 and the second temperature T2 is computed. For example, the difference between the first temperature (25° C.) and the second temperature T2 (27° C.) is computed to acquire the temperature difference Δt (2° C.).

A step S14 is a driving voltage correction step to correct the driving voltage Vh1 serving as a reference based on the temperature difference Δt. For example, the driving voltage Vh1 is corrected based on the temperature difference Δt (2° C.) between the first temperature T1 and the second temperature T2 so as to obtain a driving voltage Vh2 newly corrected. The correction is conducted by the following manner. The driving voltages Vh2 to be corrected are prepared as a data table in accordance with the temperature differences Δt in the driving voltage correction data 86. Only one corrected driving voltage Vh2 (27Vh) is acquired from the data table in accordance with a specific temperature difference Δt (2° C.). As another correction method, only one constant corresponding to the temperature difference Δt may be selected out of a plurality of constants prepared in the driving voltage correction data 86 in advance, and the selected constant may be multiplied by the driving voltage Vh1 to acquire the corrected driving voltage Vh2 (27Vh).

A step S15 is a first driving voltage generation step to generate a driving voltage applied to the head 14. Further in detail, a step to generate a driving voltage of about a threshold level by which the droplets 36 are not discharged from the head 14. As shown in FIG. 7, a driving voltage applied to the head 14 is generated in a transitional period (a period P3) from the head waiting state to the head driven state. As the driving voltage in the period P3, a driving voltage having a non-discharge driving waveform 65 shown in FIG. 5B is generated for the head 14. Further in detail, the non-discharge driving waveform 65 has an approximate trapezoid shape. It is preferable a non-discharge voltage 66 (Vh3), which is a peak value of the driving voltage in a non-discharge state, largely vibrates the piezoelectric element 35 at an extent not discharging the droplets 36. In the embodiment, the non-discharge voltage 66 is, for example, set approximately one third of a discharge voltage 63. In a non-discharge driving waveform interval 67 that is an interval between the non-discharge drive waveforms 65, the piezoelectric element 35 may be driven at an extent being vibrated. In the embodiment, the non-discharge waveform interval 67 is formed with an approximately same interval of the discharge waveform interval 64.

In a step S16, the driving voltage generated in the step S15 is applied to the head 14 to drive the head 14 (head preliminary drive). In the step S16, the head 14 is driven to increase the temperature to a predetermined head temperature. That is, the period P3 of the head preliminary drive is a warm-up period.

In a step S17, whether the temperature of the head 14 reaches a predetermined temperature or not is determined. In the embodiment, whether the head 14 reaches the second temperature T2 or not is determined. If it reaches the second temperature T2 (YES), the method proceeds to a step S18, if NO, to a step S16 to continue a warm-up operation.

A step S18 is a second driving voltage generation step to generate a driving voltage applied to the head 14. Further in detail, the driving voltage Vh2 (27Vh) corrected in the step S14 is generated for the head 14 in the period P2 of the head driven state.

In a step S19, the functional liquid 33 is discharged to the workpiece 7 as the droplets 36 so that the workpiece 7 is coated with the droplets 36. In the step S19, the driving voltage Vh2 generated in the step S18 is used as a driving voltage to discharge the droplets 36.

In a step S20, whether the head 14 is set in the head waiting state or not is determined. If the head is set in the head waiting state (YES), the method proceeds to the step S10. In contrast, if the head is not set in the head waiting state (NO), the method ends.

A method for forming a pattern and a pattern formed member

Figure 8A:
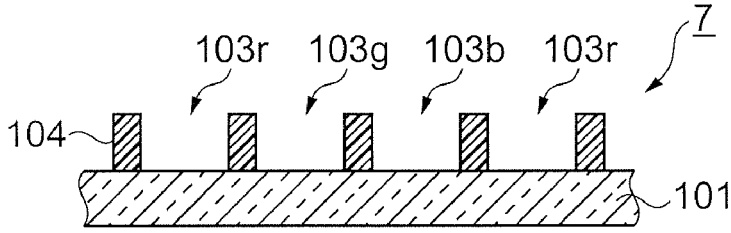
FIGS. 8A to 8C are explanatory views of a method for forming a pattern and sectional views of a color filter serving as a pattern formed member.
Figure 8B:
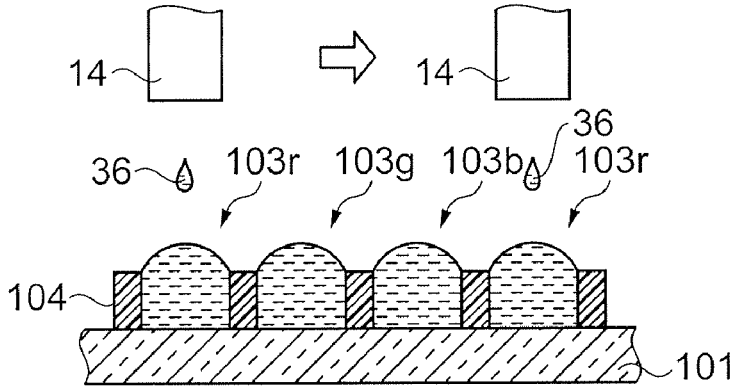
Figure 8C:
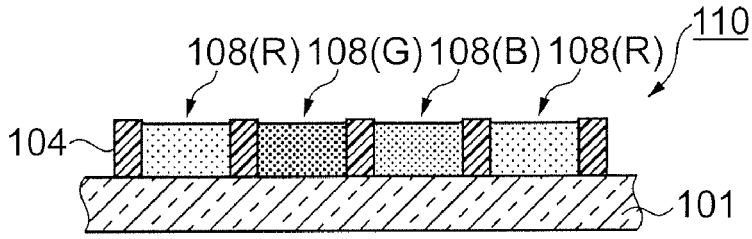

Next, a method for forming a pattern, and a pattern formed member are described. FIGS. 8A to 8C show a method for forming a pattern. In the method, a droplet is discharged to the substrate 7 by using the method for discharging a droplet (FIG. 6). In the embodiment, a color filter is an example of the pattern formed member formed by the method for forming a pattern with the droplet discharge device 1. FIGS. 8A to 8C are schematic sectional views showing a method for forming a color filter.

FIG. 8A shows a method for forming a base serving as a workpiece. In the substrate 7, a partition 104 is formed in a predetermined region of one surface of a substrate 101 made of transparent glass or the like. The partition 104 can be formed by using a method such as photolithography, printing, and an inkjet method. As a result of forming the partition 104, a colored layer region 103 is formed that serves as a filter element. In the embodiment, in order to form filter elements for three colors (red: R, green: G, and blue: B), colored layer regions 103*r*, 103*g*, and 103*b* are formed corresponding to respective colors.

FIG. 8B is a view showing the method for discharging a droplet. As described with reference to FIG. 6 and FIG. 7, the driving voltage is corrected in the head waiting state (period P1), and thereafter the head preliminary drive (period P3) is conducted. When the temperature of the head 14 reaches the second temperature T2 as a predetermined temperature, the corrected driving voltage Vh2 is applied to the head 14 so as to discharge the droplets 36 containing the colored layer forming materials to the colored layer regions 103*r*, 103*g*, and 103*b* from the head 14.

Then, solvent components of a liquid body applied to the substrate 101 are evaporated so as to form a colored layer 108 made of the colored layer forming materials as shown in FIG. 8C. A color filter 110 is thus formed.

Electro-Optical Device

Figure 9:
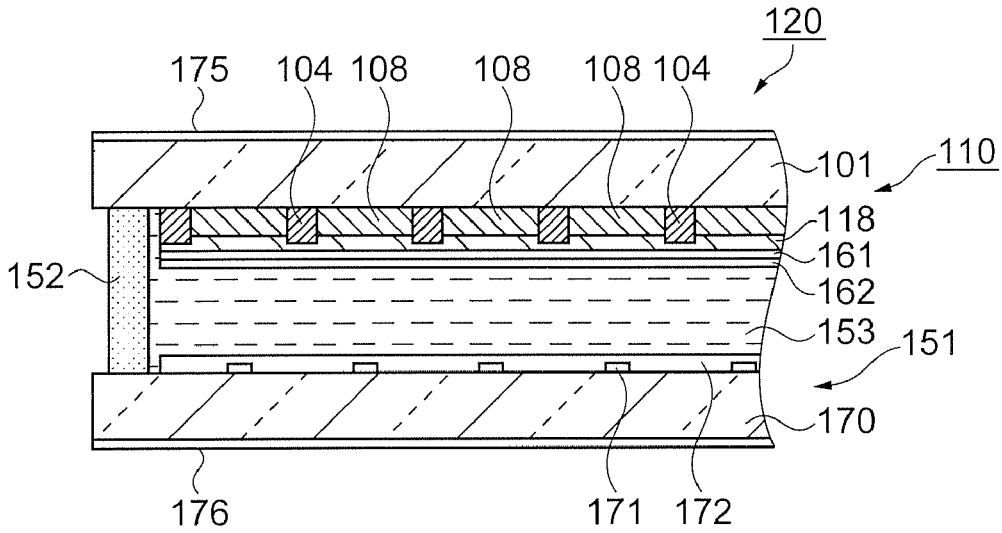
FIG. 9 is a sectional view of a liquid crystal display serving as an electro-optical device.

Next, an electro-optical device according to the embodiment is described. FIG. 9 is a sectional view showing the structure of a liquid crystal display serving as an electro-optical device.

As shown in FIG. 9, a liquid crystal display 120 includes a color filter 110, an element substrate 151 disposed so as to oppose the color filter 110, liquid crystal 153 filling in a gap between the color filter 110 and the element substrate 151 both of which are adhesively bonded with a sealant 152, and the like.

A common electrode 161 is formed on a protective film 118 of the color filter 110. On the common electrode 161, an orientation film 162 is formed. A polarizing plate 175 is disposed on a surface of the substrate 101. The surface opposes another surface, on which the colored layer 108 is formed, of the substrate 101.

The element substrate 151 includes a substrate 170 having a transparency, thin film transistor (TFT) elements 171 formed on the substrate 170, an orientation film 172 formed on the substrate 170 and the TFT elements 171, and the like. A polarizing plate 176 is disposed on a surface of the substrate 170. The surface opposes another surface, on which the colored layer 171 is formed, of the substrate 170.

Electronic Apparatus

Figure 10:
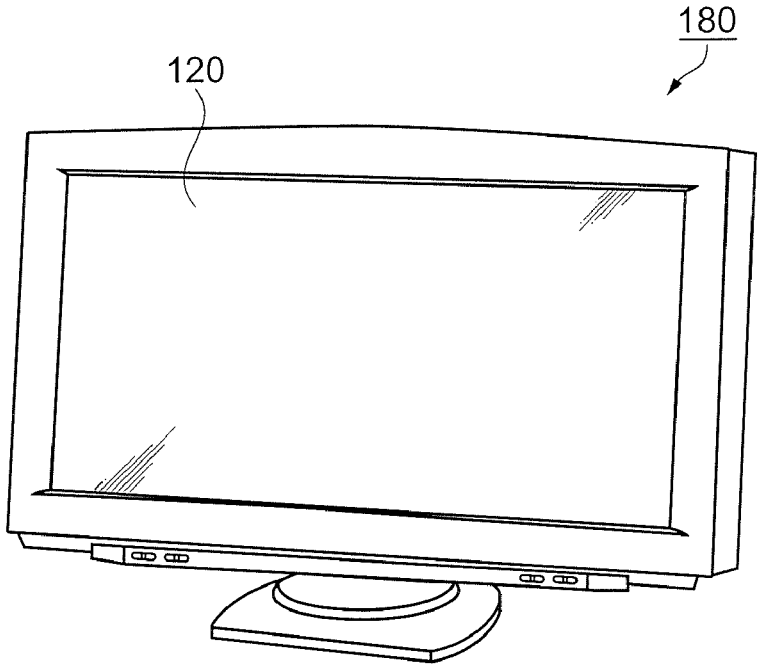
FIG. 10 is a perspective view showing the structure of a television receiver serving as an electronic apparatus.

Next, an electronic apparatus according to the embodiment is described. FIG. 10 is a perspective view showing the structure of a television receiver serving as an electronic apparatus. In FIG. 10, a liquid crystal display 120 is mounted in a display section of a television receiver 180.

The first embodiment provides the following effects.

The temperature T1 of the head 14 in the head waiting state (period P1) and the temperature T2 of the head 14 in the head driven state (period P2) are acquired to compute the temperature difference Δt between the temperature T1 and the temperature T2. In the head waiting state (period p2), a driving voltage to obtain a desired droplet amount in the head driven state is acquired as the driving voltage Vh1 serving as a reference. The driving voltage Vh1 serving as a reference is corrected based on the temperature difference Δt. The corrected driving voltage Vh2 is applied as a driving voltage for the head 14 in the head driven period (period P2). As a result, the droplets 36 of a desired amount can be discharged in the head driven state (period P2) since the driving voltage Vh2 corrected in accordance with the temperature change of the head 14 is applied. That is, the driving voltage Vh1 that is acquired in the head waiting state (period P1) as a reference is not applied in the head driven state without change.

The head preliminary drive (period P3) is set in the transient period from the head waiting period (period P1) to the head driven period (period P2). Accordingly, the temperature of the head 14 efficiently can increase from the first temperature T1 in the head waiting state (period P1) to the second temperature T2 in the head driven state (period P2).

Second Embodiment

A second embodiment of the invention is described. The basic structures of the droplet discharge device and the head, the pattern formed member, and the structures of the electro-optical device and the electronic apparatus are the same of those in the first embodiment. The descriptions are omitted.

Droplet Discharge Method

Figure 11:
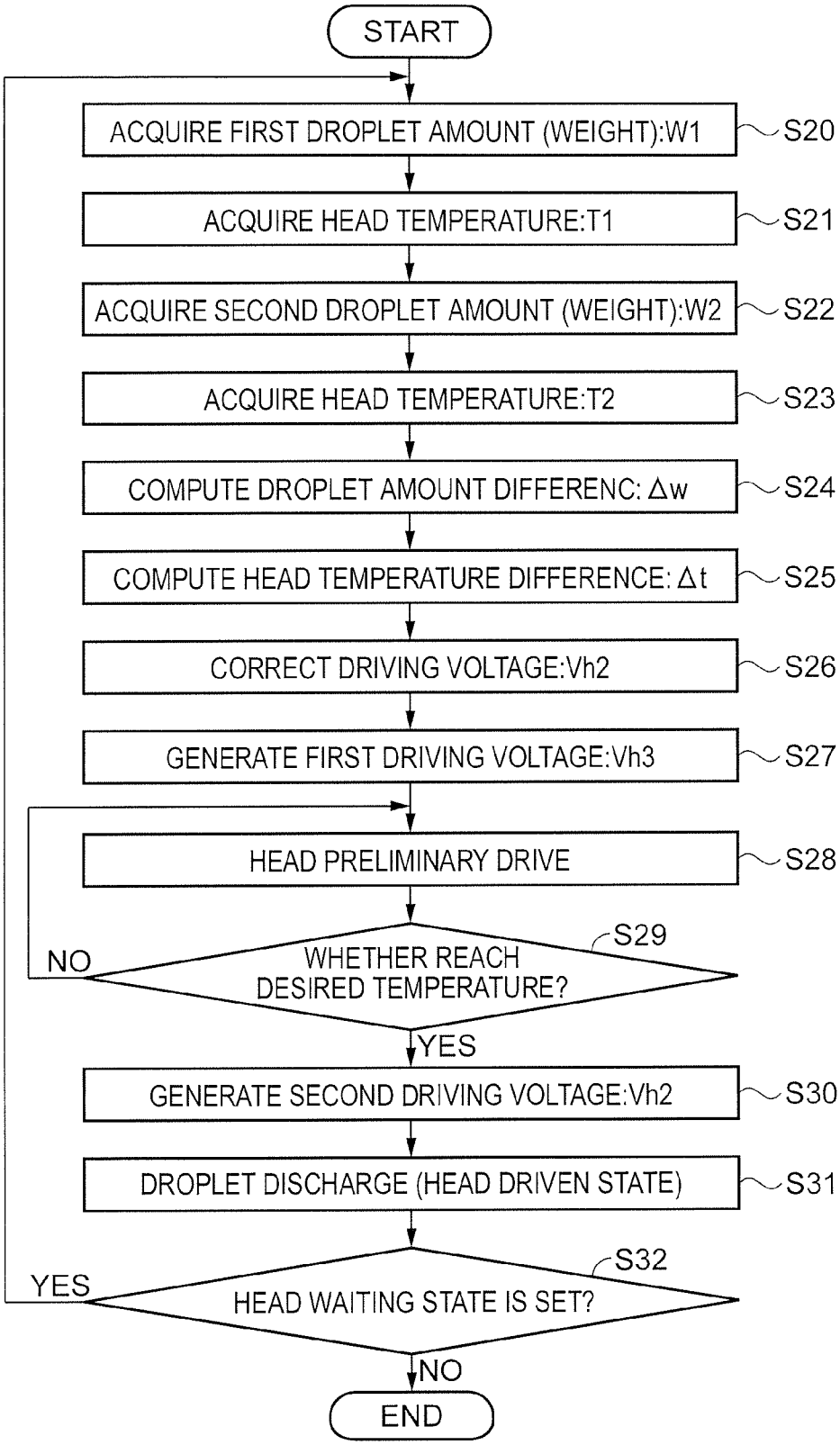
FIG. 11 is a flow chart showing a method for discharging a droplet in a second embodiment.

A method for discharging a droplet of the second embodiment is described with reference to FIGS. 5A, 5B, 7 and 11. FIG. 11 is a flowchart showing the method of discharging a droplet of the embodiment.

A step S20 is a first droplet amount acquisition step in which a driving voltage serving as a reference is applied to the head 14, in the head waiting state, so as to acquire a droplet amount discharged from the head 14 as a first droplet amount W1. Specifically, in the head waiting state in which the head 14 is positioned at a side adjacent to the droplet weight measuring device 22 (in the period P1 shown in FIG. 7), a driving voltage (driving voltage in the head driven state, e.g., 33Vh) with which the droplets 36 having a constant weight are stably discharged in the head driven state (period P2) is applied to the head 14 as the driving voltage Vh1 serving as a reference so as to acquire the first droplet amount W1 (e.g., 8 pl) discharged from the head 14.

A step S21 is the first temperature acquisition step in which the temperature of the head 14 in the head waiting state is acquired as the first temperature. Specifically, the temperature of the head 14 in the head waiting state (the period P1 shown in FIG. 7) is acquired as the first temperature T1 (e.g., 25° C.). The temperature of the head 14 is measured by the temperature acquisition device 81. The structure of the temperature acquisition device 81, the measuring method and the measuring places are the same as those in the method for discharging a droplet in the first embodiment. The descriptions are thus omitted.

A step S22 is a second droplet amount acquisition step in which a desired droplet amount, in the head driven state, is acquired as the second droplet amount W2. Specifically, a droplet weight (the desired droplet amount) stably discharged in the head driven state (the period P2 shown in FIG. 7) in which the head 14 is positioned at a discharged region of the substrate 7 and discharges the functional liquid 33 is acquired as the second droplet amount W2 (e.g., 10 pl). Alternatively, a known droplet amount acquired in setting conditions in the head driven state may be employed as the second droplet amount W2.

A step S23 is the second temperature acquisition step in which the temperature of the head 14 in the head driven state is acquired as the second temperature. Specifically, the temperature of the head 14 in the head driven state (the period P2 shown in FIG. 7) is acquired as the second temperature T2 (e.g., 27° C.). The temperature of the head 14 is measured by the temperature acquisition device 81. The structure of the temperature acquisition device 81, the measuring method and the measuring places are the same as those in the method for discharging a droplet in the first embodiment. The descriptions are thus omitted. Alternatively, a known temperature acquired in setting conditions in the head driven state may be employed as the second temperature T2.

A step S24 is a droplet amount difference computing step in which the droplet amount difference Δw between the first droplet amount W1 and the second droplet amount W2 is computed. Specifically, the difference between the first droplet amount W1 (8 pl) and the second droplet amount W2 (10 pl) is computed to acquire the droplet amount difference Δw (2 pl).

A step S25 is the temperature difference computing step in which the temperature difference between the first and second temperatures is computed. Specifically, the difference between the first temperature T1 (25° C.) and the second temperature T2 (27° C.) is computed to acquire the temperature difference Δt (2° C.).

A step S26 is a driving voltage correction step to correct the driving voltage Vh1 serving as a reference based on the droplet amount difference Δw and the temperature difference Δt. Specifically, the driving voltage Vh1 (33Vh1) is corrected based on the droplet amount difference Δw (2 pl) and the temperature difference Δt (2° C.). The correction is conducted by the following manner. The driving voltages Vh2 to be corrected are prepared as a data table in accordance with the droplet amount difference Δw and the temperature differences Δt in the driving voltage correction data 86 in the memory 41. Only one corrected driving voltage Vh2 (31Vh) is acquired from the data table in accordance with a specific droplet amount difference Δw (2 pl) and a specific temperature difference Δt (2° C.). As another correction method, only one constant corresponding to the droplet amount difference Δw and the temperature difference Δt may be selected out of a plurality of constants prepared in the driving voltage correction data 86 in advance, and the selected constant may be multiplied by the driving voltage Vh1 to acquire the corrected driving voltage Vh2 (31Vh).

A step S27 is the first driving voltage generation step to generate a driving voltage applied to the head 14. Further in detail, a step to generate a driving voltage of about a threshold level by which the droplets 36 are not discharged from the head 14. As shown in FIG. 7, a driving voltage applied to the head 14 in the period P3 from the head waiting state to the head driven state. As the driving voltage in the period P3, the driving voltage having the non-discharge driving waveform 65 shown in FIG. 5B is generated for the head 14. Further in detail, the non-discharge driving waveform 65 has an approximate trapezoid shape. It is preferable the non-discharge voltage 66 (Vh3), which is a peak value of the driving voltage in the non-discharge state, largely vibrates the piezoelectric element 35 at an extent not discharging the droplets 36. In the embodiment, the non-discharge voltage 66 is, for example, set approximately one third of a discharge voltage 63. In the non-discharge waveform interval 67 that is an interval between the non-discharge driving waveforms 65, the piezoelectric element 35 may be driven at an extent being vibrated. In the embodiment, the non-discharge waveform interval 67 is formed with an approximately same interval of the discharge waveform interval 64.

In a step S28, the driving voltage generated in the step S27 is applied to the head 14 to drive the head 14 (head preliminary drive). In the step S28, the head 14 is driven to increase the temperature to a predetermined head temperature. That is, the period P3 of the head preliminary drive is a warm-up period.

In a step S29, whether the temperature of the head 14 reaches a predetermined temperature or not is determined. In the embodiment, whether the head 14 reaches the second temperature T2 or not is determined. If it reaches the second temperature T2 (YES), the method proceeds to a step S30, if NO, to a step S28 to continue a warm-up operation.

A step S30 is the second driving voltage generation step to generate a driving voltage applied to the head 14. Further in detail, the driving voltage Vh2 (31Vh) corrected in the step S26 is generated for the head 14 in the period P2 of the head driven state.

In a step S31, the functional liquid 33 is discharged to the substrate 7 as the droplets 36 so that the substrate 7 is coated with the droplets 36. In the step S31, the driving voltage Vh2 generated in the step S30 is used as a driving voltage to discharge the droplets 36.

In a step S32, whether the head 14 is set in the head waiting state or not is determined. If the head is set in the head waiting state (YES), the method proceeds to the step S20. In contrast, if the head is not set in the head waiting state (NO), the method ends.

The second embodiment provides the following effects in addition to those of the first embodiment.

The driving voltage in the head driven state needs to be regulated taking into consideration a droplet discharge property change due to the aging deterioration of the head 14 (e.g., a head deformation). Thus, in the embodiment, the driving voltage Vh1 serving as a reference in the head driven state is corrected based on the droplet amount difference Δw and the temperature difference Δt. The corrected driving voltage Vh2 is applied to the head 14 in the head driven state. As a result, the droplets 36 can be discharged from the head 14 in the head driven state as is desired even if the head 14 is time degraded.

It is understood that the invention is not limited to the embodiments described above, and the following modifications can be made.

Modification 1

In the embodiments, the first temperature T1 in the head waiting state is lower than the second temperature T2 in the head driven state. However, the temperature condition is not limited to this. For example, the second temperature T2 of the head 14 in the head driven state may be higher than the first temperature T1 of the head 14 in the head waiting state depending on a condition of driving the droplet discharge device 1 and external conditions. Although such conditions, the temperature difference Δt between the first temperature T1 and the second temperature T2 can be computed.

Modification 2

In the embodiments, the head waiting state is described based on a time at which the weight of droplets is measured. However, the head waiting state is not limited to the time. The head waiting state may include any state, as long as the head is waited, such as the flushing process, capping process, wiping process, and cleaning process. In addition, a state may also be included in which the head is waited in the discharged region of the workpiece. In this case, the temperature difference Δt between the head waiting state and the head driven state also can be computed.

Modification 3

In the embodiments, measuring temperature, regulating a voltage, or the like are conducted on a head-by-head basis. However, the basis is not limited to this. The temperature measurement and the regulation may be conducted on a nozzle-by-nozzle basis. Since the discharged droplet amount fluctuates due to the influence of the temperature of the functional liquid, the temperature measurement and the regulation may be conducted on a basis in which the influence likely occurs in common. For example, nozzle groups having a common flow channel are employed as a nozzle group-by-nozzle group basis.

Modification 4

In the embodiments, the droplet 36 containing a colored layer forming material serving as a filter element is exemplified as one of the functional liquid. The material, however, is not limited to this, and can include materials such as electroluminescence (EL) materials, silica glass precursors, conductive materials including metal compounds, and dielectric materials. Although in this case, the functional liquid can be discharged as droplets.

Modification 5

In the embodiments, the pattern forming method is described by employing a color filter to which the method is applied. The pattern forming method is not limited to this. The method also can be applied to forming EL devices, various semiconductor elements such as thin film transistors and thin film diodes, various wiring patterns, and insulation films.

The entire disclosure of Japanese Patent Application No. 2008-150173, filed Jun. 9, 2008 is expressly incorporated by reference herein.

What is claimed is:

1. A droplet discharge device, comprising:

a head driven to discharge a functional liquid as a droplet;

a driving voltage generation unit that generates a driving voltage to drive the head;

a first temperature acquisition unit configured to acquire a temperature of the functional liquid in the head as a first temperature in a case where the head is in a head waiting state in which the head is waited;

a second temperature acquisition unit configured to acquire a temperature of the functional liquid in the head as a second temperature in a case where the head is in a head driven state in which the head is driven;

a temperature difference computing unit configured to compute a temperature difference between the first temperature and the second temperature;

a driving voltage correction unit configured to correct the driving voltage based on the temperature difference, wherein the driving voltage generation unit is configured to generate the corrected driving voltage to the head in a case where the head is in the head driven state.

2. The droplet discharge device according to claim 1, wherein: the first temperature acquisition unit acquires a temperature of the head as the first temperature if the head is in the head waiting state instead of the temperature of the functional liquid; the second temperature acquisition unit acquires a temperature of the head as the second temperature if the head is in the head driven state instead of the temperature of the functional liquid; and the temperature difference computing unit computes a temperature difference between the first and second temperatures of the head.

3. The droplet discharge device according to claim 1 further comprising a driving voltage acquisition unit that acquires a reference driving voltage serving as a reference to discharge a desired droplet amount in the head driven state by applying the driving voltage to the head in the head waiting state, wherein the driving voltage correction unit corrects the reference driving voltage based on the temperature difference.

4. The droplet discharge device according to claim 1 further comprising:

a first droplet amount acquisition unit that acquires a first droplet amount discharged from the head by applying the reference driving voltage used in the head driven state to the head in the head waiting state;

a second droplet amount acquisition unit that acquires a desired second droplet amount in the head driven state; and a droplet amount difference computing unit that computes a droplet amount difference between the first droplet amount and the second droplet amount, wherein the driving voltage correction unit corrects the reference driving voltage based on the droplet amount difference and the temperature difference.

5. The droplet discharge device according to claim 1, wherein the head is positioned in an area excluding a region of a workpiece, and the region is coated with the droplet discharged from the head.

6. The droplet discharge device according to claim 1, wherein the driving voltage correction unit selects one piece of correction data of the driving voltage out of a plurality of pieces of correction data of the driving voltage, and the one piece of the correction data corresponds to the temperature difference.

7. The droplet discharge device according to claim 1, wherein the driving voltage correction unit selects one correction constant of the driving voltage out of a plurality of correction constants of the driving voltage, and the one correction constant corresponds to the temperature difference.

8. The droplet discharge device according to claim 1, wherein the driving voltage generation unit generates the driving voltage of an about a threshold level by which the droplet is not discharged from the head in a transitional period from the head waiting state to the head driven state.

9. A method for discharging a droplet of a functional liquid by driving a head, the method comprising:

applying a driving voltage to the head in a head waiting state in which the head is waited so as to acquire a reference driving voltage serving as a reference to discharge a desired droplet amount in a head driven state in which the head is driven;

acquiring a first temperature of the head in the head waiting state;

acquiring a second temperature of the head in the head driven state;

computing a temperature difference between the first temperature and the second temperature;

correcting the reference driving voltage based on the temperature difference; and generating the corrected driving voltage to the head in the head driving state.

10. A method for discharging a droplet of a functional liquid by driving a head, the method comprising:

applying a reference driving voltage used in a head driven state in which the head is driven, in a head waiting state in which the head is waited, so as to acquire a first droplet amount discharged from the head;

acquiring a first temperature of the head in the head waiting state;

acquiring a desired second droplet amount in the head driven state;

acquiring a second temperature of the head in the head driven state;

computing a droplet amount difference between the first droplet amount and the second droplet amount;

computing a temperature difference between the first temperature and the second temperature;

correcting the reference driving voltage based on the droplet amount difference and the temperature difference; and generating the corrected driving voltage to the head in the head driving state.

11. A method for forming a pattern, comprising forming the pattern to a workpiece with the droplet discharged by the method for discharging a droplet according to claim 9.

* * * * *